US006624070B2

(12) United States Patent
Merricks et al.

(10) Patent No.: US 6,624,070 B2
(45) Date of Patent: Sep. 23, 2003

(54) PLATING CATALYSTS

(75) Inventors: David Merricks, Coventry (GB); Martin T. Goosey, Nuneaton (GB); Narinder Bains, Wolverhampton (GB)

(73) Assignee: Shipley Company, L.L.C., Marlborough, MA (US)

( * ) Notice: Subject to any disclaimer, the term of this patent is extended or adjusted under 35 U.S.C. 154(b) by 6 days.

(21) Appl. No.: 10/000,981

(22) Filed: Oct. 24, 2001

(65) Prior Publication Data

US 2002/0132042 A1 Sep. 19, 2002

(30) Foreign Application Priority Data

Oct. 24, 2000 (GB) ..... 0025989

(51) Int. Cl.[7] ..... H01L 21/44

(52) U.S. Cl. ..... 438/678; 438/679; 438/686; 438/687

(58) Field of Search ..... 438/678, 679, 438/686, 687

(56) References Cited

U.S. PATENT DOCUMENTS

| | | | | | |
|---|---|---|---|---|---|
| 4,563,217 | A | * | 1/1986 | Kikuchi et al. | 106/1.23 |
| 4,574,095 | A | * | 3/1986 | Baum et al. | 427/53.1 |
| 5,240,497 | A | * | 8/1993 | Shacham et al. | 106/1.26 |
| 5,424,252 | A | * | 6/1995 | Morishita | 437/230 |
| 5,824,599 | A | * | 10/1998 | Schacham-Diamand et al. | 438/678 |
| 5,969,422 | A | * | 10/1999 | Tinge et al. | 257/762 |
| 6,265,075 | B1 | * | 7/2001 | Klueppel et al. | 428/418 |
| 6,358,832 | B1 | * | 3/2002 | Edelstein et al. | 438/687 |

FOREIGN PATENT DOCUMENTS

| | | | |
|---|---|---|---|
| JP | 200-183160 | * | 6/2000 |

* cited by examiner

*Primary Examiner*—John F. Niebling
*Assistant Examiner*—Lynne A. Gurley
(74) *Attorney, Agent, or Firm*—S. Matthew Cairns

(57) ABSTRACT

Disclosed are catalyst compositions suitable for depositing electroless metal seed layers and for enhancing discontinuous seed layers. Also disclosed are methods of depositing electroless seed layers and enhancing discontinuous seed layers.

27 Claims, No Drawings

PLATING CATALYSTS

BACKGROUND OF THE INVENTION

The present invention relates generally to the field of seed layers for subsequent metallization. In particular, this invention relates to methods for depositing and repairing seed layers prior to metallization.

The trend toward smaller microelectronic devices, such as those with sub-micron geometries, has resulted in devices with multiple metallization layers to handle the higher densities. One common metal used for forming metal lines, also referred to as wiring, on a semiconductor wafer is aluminum. Aluminum has the advantage of being relatively inexpensive, having low resistivity, and being relatively easy to etch. Aluminum has also been used to form interconnections in vias to connect the different metal layers. However, as the size of via/contact holes shrinks to the sub-micron region, a step coverage problem appears which in turn can cause reliability problems when using aluminum to form the interconnections between the different metal layers. Such poor step coverage results in high current density and enhances electromigration.

One approach to providing improved interconnection paths in the vias is to form completely filled plugs by using metals such as tungsten while using aluminum for the metal layers. However, tungsten processes are expensive and complicated, tungsten has high resistivity, and tungsten plugs are susceptible to voids and form poor interfaces with the wiring layers.

Copper has been proposed as a replacement material for interconnect metallizations. Copper has the advantages of improved electrical properties as compared to tungsten and better electromigration property and lower resistivity than aluminum. The drawbacks to copper are that it is more difficult to etch as compared to aluminum and tungsten and it has a tendency to migrate into the dielectric layer, such as silicon dioxide. To prevent such migration, a barrier layer, such as titanium nitride, tantalum nitride and the like, must be used prior to the depositing of a copper layer.

Typical techniques for applying a metal layer, such as electrochemical deposition, are only suitable for applying copper to an electrically conductive layer. Thus, an underlying conductive seed layer, typically a metal seed layer such as copper, is generally applied to the substrate prior to electrochemically depositing copper. Such seed layers may be applied by a variety of methods, such as physical vapor deposition ("PVD") and chemical vapor deposition ("CVD"). Typically, seed layers are thin in comparison to other metal layers, such as from 50 to 1500 angstroms thick.

Oxide on a metal seed layer, particularly a copper seed layer, interferes with subsequent copper deposition. Such oxide forms from exposure of the metal seed layer to sources of oxygen, such as air. Typically, the longer such seed layer is exposed to oxygen, the greater the amount of oxide formation. Where a copper seed layer is thin, the copper oxide may exist as copper oxide throughout the layer. In other areas of electroplating, such as in electronics finishing, copper oxide layers are typically removed by acidic etching baths. These baths dissolve the oxide layer, leaving a copper metal surface. Such etching processes are not generally applicable to copper seed layers because of the thinness of the seed layer. As the oxide is removed from the seed layer surface there is the danger that the entire seed layer may be removed in places, creating discontinuities in the seed layer.

U.S. Pat. No. 5,824,599 (Shacham-Diamand et al.) discloses a method of preventing oxide formation on the surface of a copper seed layer by conformally blanket depositing under vacuum a catalytic copper layer over a barrier layer on a wafer and then, without breaking the vacuum, depositing a protective aluminum layer over the catalytic copper layer. Such blanket deposition of a copper layer under vacuum is typical of such procedures used commercially.

PCT patent application number WO 99/47731 (Chen) discloses a method of providing a seed layer by first vapor depositing an ultra-thin seed layer followed by electrochemically enhancing the ultra-thin seed layer to form a final seed layer using an alkaline copper bath. According to this patent application, such a two step process provides a seed layer having reduced discontinuities, i.e. areas in the seed layer where coverage of the seed layer is incomplete or lacking. However, such electrolytic copper deposits are not as conformal as electroless deposits. Thus such electrolytic deposits may not provide substantial fill of discontinuities without substantial upward plating.

Physical or chemical vapor deposition methods do not provide metal layers having as low impurity deposits as that provided by non-vapor deposition processes such as electrolytic and electroless deposition. Further, PVD methods tend to deposit metal in a line of sight fashion. Electroless deposition, unlike PVD or CVD, tends to be conformal, thus providing better aperture sidewall coverage leading to a more continuous seed layer and, consequently, reduced void formation following subsequent electroplating. However, conventional colloidal palladium catalysts for electroless plating typically contain strong acids which could strip off thin copper seed layers. Such conventional catalysts also contain tin which must be stripped prior to electroless plating. If such tin is not completely removed, defects in the plated film may result.

Organic dielectric materials used in these applications typically have a lower dielectric constant than conventional dielectric materials. However, such organic dielectrics cannot suitably be used because the processing temperatures for the physical vapor deposition of barrier layers is too high.

Thus, there is a continuing need for methods of depositing substantially continuous seed layers that conform to surface geometries in electronic devices, particularly in devices having small geometries such as 0.5 micron and below. Also, there is a need for lower temperature processes for depositing barrier layers. There is a further need for non-electrolytic methods for enhancing discontinuous seed layers.

SUMMARY OF THE INVENTION

It has been surprisingly found that the present compositions are suitable for enhancing or repairing discontinuities in a seed layer, particularly a copper seed layer. Also, the present invention is suitable for depositing thin copper seed layers without the use of tin. The present electroless plating catalysts are neutral to alkaline and thus are less harmful to thin copper seed layers than conventional acidic electroless catalysts.

In one aspect, the present invention provides a composition suitable for depositing an electroless plating catalyst on a substrate having $\leqq 1$ $\mu$m apertures including one or more metal salts, one or more copper complexing agents, one or more organic binders, one or more reducing agents and base.

In a second aspect, the present invention provides a method for depositing an electroless plating catalyst on a substrate having $\leqq 1$ $\mu$m apertures including the step of contacting the substrate with a composition including one or more metal salts, one or more copper complexing agents, one or more organic binders, one or more reducing agents and base.

In a third aspect, the present invention provides a method for enhancing a discontinuous seed layer including the steps of: contacting a substrate including a discontinuous metal seed layer with a composition including one or more metal salts, one or more copper complexing agents, one or more organic binders, one or more reducing agents and base; activating the catalyst; and contacting the catalyst with an electroless plating solution.

In a fourth aspect, the present invention provides a method for depositing a metal seed layer on a substrate including the steps of: contacting a substrate with a composition including one or more metal salts, one or more copper complexing agents, one or more organic binders, one or more reducing agents and base; activating the catalyst; and contacting the catalyst with an electroless plating solution.

In a fifth aspect, the present invention provides a method for manufacturing an integrated circuit including the steps of: contacting a substrate with a composition including one or more metal salts, one or more copper complexing agents, one or more organic binders, one or more reducing agents and base; activating the catalyst; and contacting the catalyst with an electroless plating solution.

In a sixth aspect, the present invention provides an electronic device including an electroless plating catalyst wherein the catalyst is deposited from a composition including one or more metal salts, one or more copper complexing agents, one or more organic binders, one or more reducing agents and base.

DETAILED DESCRIPTION OF THE INVENTION

As used throughout this specification, the following abbreviations shall have the following meanings, unless the context clearly indicates otherwise: ° C.=degrees Centigrade; μm=micron=micrometer; g/L=grams per liter; M=molar; HPC=hydroxypropylcellulose; HMC=hydroxymethylcellulose; TMAH=tetramethylammonium hydroxide; PVOH=poly(vinyl alcohol); KOH=potassium hydroxide; HPA=hypophosphorus acid; SF=sodium formate; and SHP=sodium hypophosphite.

As used throughout the specification, "feature" refers to the geometries on a substrate, such as, but not limited to, trenches and vias. "Apertures" refer to recessed features, such as vias and trenches. The term "small features" refers to features that are one micron or smaller in size (≦1 μm). "Very small features" refers to features that are one-half micron or smaller in size (≦0.5 μm). Likewise, "small apertures" refer to apertures that are one micron or smaller in size and "very small apertures" refer to apertures that are one-half micron or smaller in size. As used throughout this specification, the term "plating" refers to metal electroplating, unless the context clearly indicates otherwise. "Deposition" and "plating" are used interchangeably throughout this specification "Halo" refers to fluoro, chloro, bromo, and iodo. Likewise, "halide" refers to fluoride, chloride, bromide and iodide. "Alkyl" includes straight chain, branched and cyclic alkyl groups.

All percentages and ratios are by weight unless otherwise indicated. All ranges are inclusive and combinable.

The present invention provides compositions suitable for depositing an electroless plating catalyst on a substrate having ≦1 μm apertures including one or more metal ions, one or more copper complexing agents, one or more organic binders, one or more reducing agents and base. Any metal salt suitable for use as an electroless plating catalyst may be used in the present invention. Such metal salts include, but are not limited to: cobalt salts, copper salts, platinum salts, palladium salts, and the like. Copper and palladium salts are the preferred catalysts. Such salts are typically at least partially soluble in the solvent used, typically water. Thus any solvent soluble metal salt is suitable. Exemplary metal salts include metal hydroxides, metal halides, metal gluconates, metal acetates, metal sulfates, metal nitrates, metal sulfonates, metal alkylsulfonates, metal arylsulfonates, metal fluoroborates and the like. The choice of such catalysts are within the ability of one skilled in the art.

The one or more metal salts are typically present in the compositions of the invention in an amount of from about 0.1 to about 15 g/L, preferably from 0.5 to 10 g/L and more preferably from 1 to 8 g/L. A particularly useful range is from 2 to 5 g/L. Such metal salts are generally commercially available and may be used without further purification.

A wide variety of water soluble copper complexing agents may be advantageously used in the present invention. Preferably, such chelating agents are water soluble. By "water soluble" it is meant that the chelating agent is soluble in water at about 1000 ppm or greater. It is further preferred that such chelating agents are organic acids or salts thereof, and more preferably organic carboxylic acids or salts thereof. Suitable organic acids are any water soluble organic compound containing one or more carboxylate groups. Exemplary preferred organic acids include, but are not limited to: $(C_1-C_{12})$alkylcarboxylic acids, $(C_2-C_{12})$alkyldicarboxylic acids, $(C_1-C_{12})$alkyltricarboxylic acids, substituted $(C_1-C_{12})$alkylcarboxylic acids, substituted $(C_2-C_{12})$alkyldicarboxylic acids, substituted $(C_1-C_{12})$alkyltricarboxylic acids, $(C_2-C_{12})$alkenylcarboxylic acids, $(C_2-C_{12})$alkenyldicarboxylic acids, $(C_2-C_{12})$alkenyltricarboxylic acids, substituted $(C_2-C_{12})$alkenylcarboxylic acids, substituted $(C_2-C_{12})$alkenyldicarboxylic acids, substituted $(C_2-C_{12})$alkenyltricarboxylic acids, amine carboxylic acids, arylcarboxylic acids, substituted arylcarboxylic acids and the like and their salts. By "substituted alkyl," "substituted alkenyl" or "substituted aryl" it is meant that one or more hydrogens on the alkyl or alkenyl chain or aryl ring is replaced with another substituent group such as halo, hydroxyl, $(C_1-C_6)$alkoxy, cyano, $(C_1-C_6)$alkylthio, phenyl, phenoxy and the like. Amine carboxylic acids include amine tetracarboxylic acids such as ethylenediamine tetracarboxylic acid ("EDTA"), and amine pentacarboxylic acids. Particularly useful organic acids include: formic acid, acetic acid, propionic acid, oxalic acid, malonic acid, succinic acid, glutaric acid, adipic acid, glucolic acid, lactic acid, tartaric acid, citric acid, malic acid, EDTA, phthalic acid, benzenetricarboxylic acid, salicilic acid and their salts.

The amount of organic acid in the present compositions is typically in the range of from about 0.1 to about 25 g/L, preferably from 0.5 to 20 g/L and more preferably from 2 to 15 g/L. The specific amount of organic will depend upon the particular metal salt and the particular organic acid chosen. The organic acids are commercially available from a variety of sources and may be used without further purification.

A wide variety of organic binders are suitable in the present compositions. Such binders are typically water-soluble or water-dispersible, and preferably water-soluble. The binders may be small molecules or polymeric. Suitable binders include cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly(maleic anhydride/methyl vinyl ether), polymethacrylic acid, poly (vinyl alcohol) and naphthalene formaldehyde condensates. Preferred organic binders are cellulose, hydroxycellulose, hydroxymethylcellulose, hydroxyethylcellulose and hydroxypropylcellulose.

Such binders may be used in a wide range of amounts and typically in the range of from about 1 to about 30 g/L. Preferably, the organic binders are used in an amount of form 5 to 25 g/L and more preferably 10 to 20 g/L. These binders are generally commercially available and may be used without further purification.

A wide variety of reducing agents may be used in the present compositions. Suitable reducing agents include, but are not limited to, hypophosphorus acid, sodium hypophosphite, potassium hypophosphite, sodium borohydride, formaldehyde, dimethylamine borane, trimethylamine borane, methylmorpholino borane, morpholino borane, diisopropylamine borane, L-sodium ascorbate, sodium phosphite, potassium phosphite, tartaric acid, glucose, glycerine, sodium N,N-diethylglycine, sodium formate, potassium formate, titanium trichloride, hydrazine, thiourea, methylthiourea, N-methylthiourea, N-ethylthiourea, hydroquinone, bivalent cobalt compounds, and the like. Preferred reducing agents include hypophosphorus acid, sodium hypophosphite and sodium formate.

The reducing agents are typically present in the compositions of the invention in an amount of from about 5 to about 60 g/L and preferably from 10 to 50 g/L. Such reducing agents are generally commercially available and may be used without further purification.

Any suitable organic or inorganic base may be used in the present compositions. Suitable bases include, but are not limited to: alkali and alkaline earth hydroxides such as lithium hydroxide, sodium hydroxide, potassium hydroxide; ammonium hydroxide; alkylammonium hydroxides such as tetra($C_1$–$C_4$)alkylammonium hydroxides such as tetramethylammonium hydroxide; amines, carbonates and the like. Such bases are present in the compositions in an amount sufficient to provide a pH of the compositions of about 7 or greater, preferably from about 7.5 to about 13.5, more preferably from 8 to 13, still more preferably from 8.5 to 12, and even more preferably from 10 to 12. The particular pH employed depends in part upon the choice of metal salt. For example, when a copper salt is used in the present compositions, a particularly suitable pH range is from about 7.5 to about 8.0.

The present compositions may be prepared by combining the one or more metal salts, one or more organic acids, one or more organic binders, one or more reducing agents and one or more bases in any order. In one embodiment, a complexing agent is first dissolved in water, followed by a metal salt, organic binder, base, reducing agent and water to final volume. Preferably the organic binder is added to the mixture slowly to avoid clumping. Typically, the present compositions are prepared in water, but may be prepared in one or more organic solvents or in a mixture of water with one or more organic solvents. Such organic solvents may include, but are not limited to, polyhydroxy compounds such as alkanediols and alkanetriols, glycol ethers, glycol ether acetates, and the like. Alkanediols include ($C_1$–$C_{24}$) alkanediols such as glycols such as ethylene glycol, propylene glycol and the like. Exemplary glycol ethers include ethylene glycol monomethyl ether, ethylene glycol monobutyl ether, diethylene glycol monomethyl ether, diethylene glycol monobutyl ether, triethylene glycol monomethyl ether, triethylene glycol monobutyl ether, diethylene glycol dimethyl ether, diethylene glycol dibutyl ether, propylene glycol monomethyl ether, propylene glycol monobutyl ether, dipropylene glycol monomethyl ether, dipropylene glycol monobutyl ether, tripropylene glycol monomethyl ether, tripropylene glycol monobutyl ether, propylene glycol dimethyl ether, propylene glycol dibutyl ether, dipropylene glycol dimethyl ether, dipropylene glycol dibutyl ether and the like. Other suitable solvents include propylene glycol monomether ether acetate. Water and mixtures of water and organic solvents are preferred, and water is more preferred.

The catalyst compositions of the present invention may be applied to a substrate by a wide variety of means such as dipping, spraying, flood coating, screen printing, roller coating, spin-coating and the like. Suitable substrates include any used in the manufacture of electronic devices, such as, but not limited to, wafers used in the manufacture of integrated circuits, printed wiring board inner layers and outer layers, flexible circuits, multichip modules, connector, lead frames and the like. It is preferred that the substrate is a wafer. It is further preferred that the present compositions are applied to substrates having small apertures ($\leqq 1$ $\mu$m), more preferably very small apertures ($\leqq 0.5$ $\mu$m) and even more preferably $\leqq 0.18$ $\mu$m apertures. Thus, the present invention provides a method for depositing an electroless plating catalyst on a substrate having $\leqq 1$ $\mu$m apertures including the step of contacting the substrate with a composition including one or more metal salts, one or more organic acids, one or more organic binders, one or more reducing agents and base.

The amount of such electroless plating catalyst deposited on the substrate is determined by the thickness of the applied composition coating or film. Thus, the amount of catalyst deposited may be controlled by controlling the amount of the composition applied to the substrate. Such compositions applied to the substrate form substantially continuous films, i.e. the film of the complex covers >95% of the surface area of the substrate, preferably >98%, and more preferably >99%.

Once the present compositions are applied to or coated onto a substrate, they are typically dried to provide a uniform inactive catalytic film. Such drying may be by a variety of means. Preferably, such drying is performed by heating. Typically such heating is performed at a temperature lower than that needed to activate the catalyst. For example, the coated substrate may be dried in air at a temperature of up to about 100° C., and preferably up to about 90° C. Typical drying times will vary with the solvent used in the catalyst composition and the thickness of the catalyst layer applied. Such times will be within the ability of one skilled in the art, but suitable may be up to 60 minutes, preferably up to 45 minutes, and more preferably up to 30 minutes.

After drying, the inactive catalytic film is activated prior to electroless metal deposition. Thus, the present method further includes an activation step. The inactive catalytic film may be activated by a variety of means such as heating such as at elevated temperatures, exposure to carbon dioxide or eximer lasers, exposure to ultraviolet radiation and the like. Preferably, catalyst is activated by heating at elevated temperatures such as by placing the catalyst coated substrate in an oven. Such heating is typically at a temperature of about ≧100° C., preferably ≧110° C., more preferably ≧120° C., still more preferably ≧130° C., and even more preferably ≧140° C. or greater such as ≧200° C. Such heating to activate the catalyst is typically up to 180 minutes, preferably up to 120 minutes, more preferably up to 60 minutes, and even more preferably up to 15 minutes. It will be appreciated by those skilled in the art that selective activation of the catalyst is possible using a laser or using UV radiation through a mask.

Once the present catalysts are activated, they may be electrolessly plated by a wide variety of metals. Suitable metals that can be electrolessly deposited include, but are not limited to, copper, nickel, gold, silver, cobalt, palladium, platinum, iron and the like. Such electroless plating solutions typically contain one or more metal ions, one or more reducing agents and optionally a complexing agent. Typically, electroless plating solutions are aqueous, but may also contain one or more organic solvents.

The present invention is particularly suitable for enhancing a discontinuous metal seed layer on a substrate. By "enhancing" a discontinuous metal seed layer is meant that the seed layer is repaired or extended to substantially fill in, and preferably fill in, such discontinuities or areas devoid of seed layer. Thus, the present invention provides a method for enhancing a discontinuous seed layer including the steps of: contacting a substrate including a discontinuous metal seed layer with a composition including one or more metal salts, one or more organic acids, one or more organic binders, one or more reducing agents and base; activating the catalyst; and contacting the catalyst with an electroless plating solution.

In an alternative embodiment, the present invention is particularly suitable for depositing a seed layer on a substrate. Such seed layer is deposited electrolessly, which has the advantage of being conformal. Thus, uniform conformal seed layers are obtained which overcome the problems of conventional seed layers. Conventional electroless catalysts include palladium which increases the resistivity of a subsequently deposited copper layer. The present invention allows for the use of copper in place of palladium as the catalyst. Such catalysts including a copper salt are particularly advantageous in seed layer deposition because the resistivity of the subsequently deposited copper layer is not increased.

Thus, the present invention provides a method for depositing a metal seed layer on a substrate including the steps of: contacting a substrate with a composition including one or more metal salts, one or more organic acids, one or more organic binders, one or more reducing agents and base; activating the catalyst; and contacting the catalyst with an electroless plating solution. When the present invention is used to deposit a seed layer on an integrated circuit device, the catalyst composition is preferably applied to a barrier layer. Suitable barrier layers are any which reduce or prevent the electromigration of copper. Suitable barrier layers include, but are not limited to, tantalum, tantalum nitride, tantalum nitride silicide, titanium, titanium nitride, tungsten, tungsten nitride and tungsten nitride silicide. More than one barrier layer may be used, such as titanium followed by titanium nitride and optionally followed by titanium nitride silicide.

The present invention also provides a method for manufacturing an integrated circuit including the steps of: contacting a substrate with a composition including one or more metal salts, one or more organic acids, one or more organic binders, one or more reducing agents and base; activating the catalyst; and contacting the catalyst with an electroless plating solution. Accordingly, the present invention further provides an electronic device including an electroless plating catalyst wherein the catalyst is deposited from a composition including one or more metal salts, one or more organic acids, one or more organic binders, one or more reducing agents and base.

Once the present catalysts are activated, they may be electrolessly plated by a wide variety of metals. Suitable metals that can be electrolessly deposited include, but are not limited to, copper, nickel, gold, silver, cobalt, palladium, platinum, iron and the like. Preferably the electroless plating bath is an electroless copper plating bath. Such electroless plating solutions typically contain one or more metal ions, one or more reducing agents and optionally a complexing agent. Typically, electroless plating solutions are aqueous, but may also contain one or more organic solvents.

The metals ions may be present in the electroless plating baths in any soluble form, such as nitrates, sulfates, sulfonates, alkylsulfonates, arylsulfonates, halides, fluoroborates, gluconates, acetates and the like. The amount of such metal ions depends upon the metal to be deposited and the particular electroless bath used. Such amounts are within the ability of one skilled in the art.

A wide variety of reducing agents may be used in such electroless baths. Suitable reducing agents include, but are not limited to, sodium hypophosphite, potassium hypophosphite, sodium borohydride, formaldehyde, dimethylamine borane, trimethylamine borane, methylmorpholino borane, morpholino borane, diisopropylamine borane, L-sodium ascorbate, sodium phosphite, potassium phosphite, tartaric acid, glucose, glycerine, sodium N,N-diethylglycine, sodium formate, potassium formate, titanium trichloride, hydrazine, thiourea, methylthiourea, N-methylthiourea, N-ethylthiourea, hydroquinone, bivalent cobalt compounds, and the like. For electroless copper baths, formaldehyde, dimethylamine borane and sodium borohydride are preferred. The amount of such reducing agent in the electroless bath is well known to those skilled in the art.

Optionally, the electroless baths may contain one or more complexing agents, such as ethylenediamine, EDTA, tetramethylenediamine, citrate salts, tartrate salts and the like.

The substrate containing the activated catalyst is typically contacted with an electroless plating bath at a temperature and for a time sufficient to deposit the desired metal layer. Such times and temperatures vary according to the metal to be deposited and the particular electroless plating bath used. Typically, such electroless plating may be performed at a temperature from below room temperature to about 95° C., and preferably from 25° to 80° C. Suitable plating times are typically at least about 0.25 minutes, preferably at least about 0.5 minute, and more preferably at least about 5 minutes. Other suitable plating times include at least about 20 minutes. There is no real upper limit to the plating time used. The longer such electroless plating is done, the thicker the resulting metal deposit. It will be appreciated by those skilled in the art that the plating rate may slow as the thickness of the deposit increases.

When the present invention is used to enhance or repair a seed layer having discontinuities, the substrate is contacted with the electroless plating bath for a period of time sufficient to substantially fill in, and preferably completely fill in such discontinuities. When the present invention is used to deposit a seed layer, such seed layers may be of varying thicknesses. The present invention allows for deposition of ultra-thin, conformal seed layers without the need for vapor deposition.

It will be appreciated that the substrates may be plated until any apertures present in the substrates are substantially filled or completely filled by the electroless metal deposit. This has the advantage that only one plating bath needs to be employed in the plating of such substrates. As electroless deposition tends to be conformal, it is preferred that the electroless metal deposit does not completely fill the apertures. Thus, it is preferred that the electroless deposit partially fills the apertures and then the substrate is removed from the electroless bath and plated electrolytically, preferably with the same metal. In this way, void-free bottom-up fill is provided in small apertures, and particularly in apertures $\leqq 0.18$ $\mu$m.

Accordingly, the present invention also provides an article of manufacture including an electronic device substrate containing one or more apertures, each aperture containing an electroless metal deposit obtained from the method of the present invention.

Once a semiconductor wafer is plated to fill the apertures according to the present invention, the wafer is preferably subjected to chemical-mechanical planarization ("CMP"). A CMP procedure can be conducted in accordance with the invention as follows.

The wafer is mounted in a wafer carrier which urges the wafer against the surface of a moving polishing pad. The polishing pad can be a conventional smooth polishing pad or a grooved polishing pad. Such grooved pads are well known in the art, such as those available from Rodel, Inc., Newark, Del. The polishing pad can be located on a conventional platen which can rotate the polishing pad. The polishing pad can be held on the platen by a holding means such as, but not limited to, an adhesive, such as, two faced tape having adhesive on both sides.

A polishing solution or slurry is fed onto the polishing pad. The wafer carrier can be at a different positions on the polishing pad. The wafer can be held in position by any suitable holding means such as, but is not limited to, a wafer holder, vacuum or liquid tensioning such as, but not limited to a fluid such as, but not limited to water. If the holding means is by vacuum then there is preferably a hollow shaft which is connected to the wafer carrier. Additionally, the hollow shaft could be used to regulate gas pressure, such as, but not limited to air or an inert gas or use a vacuum to initially hold the wafer. The gas or vacuum would flow from the hollow shaft to the carrier. The gas can urge the wafer against the polishing pad for the desired contour. The vacuum can initially hold the wafer into position in the wafer carrier. Once the wafer is located on top of the polishing pad the vacuum can be disengaged and the gas pressure can be engaged to thrust the wafer against the polishing pad. The excess or unwanted copper is then removed. The platen and wafer carrier can be independently rotatable. Therefore, it is possible to rotate the wafer in the same direction as the polishing pad at the same or different speed or rotate the wafer in the opposite direction as the polishing pad.

Thus, the present invention provides a method for removing excess material from a semiconductor wafer by using a chemical mechanical planarization process which includes contacting the semiconductor wafer with a rotating polishing pad thereby removing the excess material from the semiconductor wafer; wherein the semiconductor wafer contains a seed layer which has been prior deposited or enhanced according the method described above.

The following examples are presented to illustrate further various aspects of the present invention, but are not intended to limit the scope of the invention in any aspect.

EXAMPLE 1

The following catalyst samples are prepared by combining the ingredients and amounts d in the Table with water.

TABLE

| Sample | Metal Salt | Organic Acid | Organic Binder | Base | Reducing Agent |
|---|---|---|---|---|---|
| 1 | $CuCl_2$ (3 g/L) | Tartaric acid (2 g/L) | HPC (11 g/L) | 13 M KOH (4 g/L) | HPA (25 g/L) |
| 2 | $CuCl_2$ (4 g/L) | Tartaric acid (5 g/L) | HPC (11 g/L) | 13 M KOH (6 g/L) | HPA (25 g/L) |
| 3 | $CuCl_2$ (4 g/L) | Tartaric acid (7 g/L) | HPC (11 g/L) | 13 M KOH (10 g/L) | SHP (40 g/L) |
| 4 | $CuCl_2$ (5 g/L) | Tartaric acid (11 g/L) | HPC (11 g/L) | 13 M KOH (23 g/L) | SF (10 g/L) |
| 5 | $CuCl_2$ (4.5 g/L) | Tartaric acid (11 g/L) | HPC (11 g/L) | 13 M KOH (28 g/L) | SF (50 g/L) |
| 6 | $PdCl_2$ (2 g/L) | Tartaric acid (11 g/L) | HPC (10 g/L) | 13 M KOH (28 g/L) | HPA (25 g/L) |
| 7 | $PdCl_2$ (3 g/L) | Tartaric acid (11 g/L) | HMC (15 g/L) | TMAH (20 g/L) | HPA (25 g/L) |
| 8 | $PdCl_2$ (5 g/L) | Tartaric acid (15 g/L) | HPC (12 g/L) | 13 M KOH (20 g/L) | SHP (40 g/L) |
| 9 | $PdCl_2$ (2 g/L) | Citric acid (10 g/L) | HMC (11 g/L) | 13 M KOH (30 g/L) | SF (10 g/L) |
| 10 | $CuCl_2$ (4.5 g/L) | Citric acid (7 g/L) | HMC (8 g/L) | TMAH (15 g/L) | SF (20 g/L) |
| 11 | $CuCl_2$ (5 g/L) | Citric acid (8 g/L) | PVOH (13 g/L) | TMAH (18 g/L) | SHP (35 g/L) |

EXAMPLE 2

A copper seed layer which is discontinuous is applied by PVD to a barrier layer coated silicon wafer having $\leqq 0.5$ $\mu$m apertures. Sample 1 is spin coated on the wafer and is then dried at 90° C. in air for 30 minutes. The catalyst is next activated by placing the wafer in an oven at 140° C. for 15 minutes. The wafer is then contacted with an electroless copper bath to provide a substantially continuous copper seed layer. The wafer is then electroplated with an acid copper bath to provide apertures substantially filled with copper.

EXAMPLE 3

Example 2 is repeated except that the wafer does not contain any seed layer.

EXAMPLE 4

Example 3 is repeated except that Sample 8 is used.

What is claimed is:

1. A method for depositing an electroless plating catalyst on a substrate having $\leqq 1$ $\mu$m apertures comprising the steps of: contacting the substrate with a composition comprising one or more metal salts, one or more copper complexing agents, one or more organic binders, one or more reducing agents and base; drying the deposited composition; and activating the catalyst.

2. The method of claim 1 wherein the one or more metal salts are selected from copper or palladium salts.

3. The method of claim 1 wherein the one or more copper complexing agents selected from organic acids.

4. The method of claim 3 wherein the organic acids are selected from ($C_1$–$C_{12}$)alkylcarboxylic acids, ($C_2$–$C_{12}$) alkyldicarboxylic acids, ($C_1$–$C_{12}$)alkyltricarboxylic acids, substituted ($C_1$–$C_{12}$)alkylcarboxylic acids, substituted ($C_2$–$C_{12}$)alkyldicarboxylic acids, substituted ($C_1$–$C_{12}$) alkyltricarboxylic acids, ($C_2$–$C_{12}$)alkenylcarboxylic acids, ($C_2$–$C_{12}$)alkenyldicarboxylic acids, ($C_2$–$C_{12}$) alkenyltricarboxylic acids, substituted ($C_2$–$C_{12}$) alkenylcarboxylic acids, substituted ($C_2$–$C_{12}$) alkenyldicarboxylic acids, substituted ($C_2$–$C_{12}$) alkenyltricarboxylic acids, amine carboxylic acids, arylcarboxylic acids or substituted arylcarboxylic acids.

5. The method of claim 4 wherein the one or more organic acids are selected from formic acid, acetic acid, propionic acid, oxalic acid, malonic acid, succinic acid, glutaric acid, adipic acid, glucolic acid, lactic acid, tartaric acid, citric acid or malic acid, EDTA, phthalic acid, benzene tricarboxylic acid or salicilic acid.

6. The method of claim 1 wherein the one or more organic binders are selected from cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly (maleic anhydride/methyl vinyl ether), polymethacrylic acid, poly(vinyl alcohol) or naphthalene formaldehyde condensates.

7. The method of claim 1 wherein the base is selected from lithium hydroxide, sodium hydroxide, potassium hydroxide, ammonium hydroxide or tetra($C_1$–$C_4$) alkylammonium hydroxide.

8. The method of claim 1 wherein the apertures are $\leqq 0.5$ $\mu$m.

9. A method for enhancing a discontinuous seed layer comprising the steps of: depositing an electroless plating catalyst on a substrate comprising a discontinuous metal seed layer by contacting the substrate with a composition comprising one or more metal salts, one or more copper complexing agents, one or more organic binders, one or more reducing agents and base; drying the deposited composition; activating the catalyst; and contacting the catalyst with an electroless plating solution.

10. The method of claim 9 wherein the substrate comprises apertures $\leqq 1$ $\mu$m.

11. The method of claim 9 wherein the activating step comprises heating, exposure to carbon dioxide or eximer lasers or exposure to ultraviolet radiation.

12. The method of claim 9 wherein the one or more metal salts are selected from copper or palladium salts.

13. The method of claim 9 wherein the one or more copper complexing agents are selected from organic acids.

14. The method of claim 13 wherein the organic acids are selected from ($C_1$–$C_{12}$)alkylcarboxylic acids, ($C_2$–$C_{12}$) alkyldicarboxylic acids, $C_1$–$C_{12}$)alkyltricarboxylic acids, substituted ($C_1$–$C_{12}$)alkylcarboxylic acids, substituted ($C_2$–$C_{12}$)alkyldicarboxylic acids, substituted ($C_1$–$C_{12}$) alkyltricarboxylic acids, ($C_2$–$C_{12}$)alkenylcarboxylic acids, ($C_2$–$C_{12}$)alkenyldicarboxylic acids, ($C_2$–$C_{12}$) alkenyltricarboxylic acids, substituted ($C_2$–$C_{12}$) alkenylcarboxylic acids, substituted ($C_2$–$C_{12}$) alkenyldicarboxylic acids, substituted ($C_2$–$C_{12}$) alkenyltricarboxylic acids, amine carboxylic acids, arylcarboxylic acids or substituted arylcarboxylic acids.

15. The method of claim 14 wherein the one or more organic acids are selected from formic acid, acetic acid, propionic acid, oxalic acid, malonic acid, succinic acid, glutaric acid, adipic acid, glucolic acid, lactic acid, tartaric acid, citric acid or malic acid, EDTA, phthalic acid, benzene tricarboxylic acid or salicilic acid.

16. The method of claim 9 wherein the one or more organic binders are selected from cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly(maleic anhydride/methyl vinyl ether), polymethacrylic acid, poly(vinyl alcohol) or naphthalene formaldehyde condensates.

17. The method of claim 9 wherein the base is selected from lithium hydroxide, sodium hydroxide, potassium hydroxide, ammonium hydroxide or tetra($C_1$–$C_4$) alkylammonium hydroxide.

18. A method for depositing a metal seed layer on a substrate comprising the steps of: depositing an electroless plating catalyst on the substrate by contacting the substrate with a composition comprising one or more metal salts, one or more copper complexing agents, one or more organic binders, one or more reducing agents and base; drying the deposited composition; activating the catalyst; and contacting the catalyst with an electroless plating solution.

19. The method of claim 18 wherein the substrate comprises apertures $\leqq 1$ $\mu$m.

20. The method of claim 18 wherein the activating step comprises heating, exposure to carbon dioxide or eximer lasers or exposure to ultraviolet radiation.

21. The method of claim 18 wherein the one or more metal salts are selected from copper or palladium salts.

22. The method of claim 18 wherein the one or more copper complexing agents are selected from organic acids.

23. The method of claim 22 wherein the one or more organic acids are selected from ($C_1$–$C_{12}$)alkylcarboxylic acids, ($C_2$–$C_{12}$)alkyldicarboxylic acids, ($C_1$–$C_{12}$) alkyltricarboxylic acids, substituted ($C_1$–$C_{12}$) alkylcarboxylic acids, substituted ($C_2$–$C_{12}$) alkyldicarboxylic acids, substituted ($C_1$–$C_{12}$) alkyltricarboxylic acids, ($C_2$–$C_{12}$)alkenylcarboxylic acids, ($C_2$–$C_{12}$)alkenyldicarboxylic acids, ($C_2$–$C_{12}$) alkenyltricarboxylic acids, substituted ($C_2$–$C_{12}$) alkenylcarboxylic acids, substituted ($C_2$–$C_{12}$) alkenyldicarboxylic acids, substituted ($C_2$–$C_{12}$) alkenyltricarboxylic acids, amine carboxylic acids, arylcarboxylic acids or substituted arylcarboxylic acids.

24. The method of claim 18 wherein the one or more organic acids are selected from formic acid, acetic acid, propionic acid, oxalic acid, malonic acid, succinic acid, glutaric acid, adipic acid, glucolic acid, lactic acid, tartaric acid, citric acid, malic acid, EDTA, phthalic acid, benzene tricarboxylic acid or salicilic acid.

25. The method of claim 18 wherein the one or more organic binders are selected from cellulose, hydroxycellulose, hydroxyalkylcellulose such as hydroxymethylcellulose, hydroxyethylcellulose and hydroxypropylcellulose, polysaccharide polymers, cellulose polymers, derivatized cellulose polymers, polymers and copolymers of ethylene oxide and propylene oxide, polyurethane polymers having alternating hydrophobic and hydrophilic moieties, poly(maleic anhydride/methyl vinyl ether), polymethacrylic acid or naphthalene formaldehyde condensates.

26. The method of claim 18 wherein the base is selected from lithium hydroxide, sodium hydroxide, potassium hydroxide, ammonium hydroxide or tetra($C_1$–$C_4$) alkylammonium hydroxide.

27. A method for manufacturing an integrated circuit comprising the steps of: depositing an electroless plating catalyst on a substrate by contacting a substrate with a composition comprising one or more metal salts, one or more copper complexing agents, one or more organic binders, one or more reducing agents and base; drying the deposited composition; activating the catalyst; and contacting the catalyst with an electroless plating solution.

* * * * *